US006394187B1

(12) United States Patent
Dickson et al.

(10) Patent No.: US 6,394,187 B1
(45) Date of Patent: May 28, 2002

(54) FLAPPER VALVE ASSEMBLY APPARATUS AND METHOD

(75) Inventors: Rennie L. Dickson; Michael V. Vinzant, both of Carrollton, TX (US); Paul E. Butler, Aberdeen (GB)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/516,542

(22) Filed: Mar. 1, 2000

(51) Int. Cl.[7] ..... E21B 34/00

(52) U.S. Cl. ..... 166/383; 166/386; 166/332.8; 166/334.1

(58) Field of Search ..... 166/317, 332.1, 166/332.8, 334.1, 383, 386

(56) References Cited

U.S. PATENT DOCUMENTS 4,813,481 A * 3/1989 Sproul et al. ..... 166/51
5,020,600 A * 6/1991 Coronado ..... 166/387
5,188,182 A 2/1993 Echols, III et al.
5,636,661 A * 6/1997 Moyes ..... 166/332.8

OTHER PUBLICATIONS

Halliburton Energy Services, Inc., Completion and Sand Control Products Catalog, Frangible Ceramic Flappers, ©2000, pp. 5–8, Halliburton Energy Services, Inc., U.S.A.

* cited by examiner

*Primary Examiner*—William Neuder
(74) *Attorney, Agent, or Firm*—David W. Carstens; William M. Imwalle

(57) ABSTRACT

The flapper valve assembly can be used in series to provide collapsible closures in a drill pipe. Thus, when work strings are withdrawn through the flapper valve, it will close in a conventional manner. However, when the work string must be reinserted through the closed flapper, a collar holding the flapper in its closed position can be sheared from its position within the assembly housing.

19 Claims, 3 Drawing Sheets

FLAPPER VALVE ASSEMBLY APPARATUS AND METHOD

BACKGROUND OF THE INVENTION

1. Technical Field of the Invention

The present invention relates generally to well service equipment and, in particular, to a formation protection flapper valve assembly for limiting the loss of completion fluid after a service operation has been completed.

2. Description of Related Art

Numerous operations are performed during the drilling and maintenance of subterranean wells that require the introduction of various fluids into the well for specific purposes. For example, in a gravel pack operation a service seal unit mounted on a work string is used to route service fluid along various passages. Such fluids as acids, cements, polymers, and sand-filled liquids may be injected into the formation or into the outer annulus between a sand screen and a perforated well casing. After the various operations are performed, completion fluids are introduced into the well to displace the service fluids that were used to perform the various operations. Once the completion fluid introduction operation has been completed, the apparatus used for the operation must be removed along with the tubular work string carrying the apparatus. Because substantial quantities of completion fluid are usually still contained within the apparatus and work string upon completion of the operation, this fluid will be lost and spilt into the formation when the work string is removed. The completion fluid is costly and will contaminate the formation if it is not contained. Therefore, there is a need for an apparatus or method for containing the completion fluid while the work string is removed and another apparatus for a further operation is being installed.

Several methods have been developed for preventing the completion fluid from running into the formation. One method is to spot a gel material in the bore as the work string is withdrawn in order to close the liner to fluid flow and protect the formation from the pressure of completion fluid.

Another method used for containing completion fluids is that of an automatically operating flapper valve. Such valves have been conventionally mounted on a screen support sub between the screen and the packer for pivotal movement from an upright, open bore position, to a horizontal, closed bore position. The flapper valve is propped open in the upright position during the various operations and when the work string and the apparatus are pulled out, the flapper valve is moved into the horizontal position against the valve seat, usually by a biasing mechanism. The closed valve keeps the completion fluid contained above the valve until another tubing string is inserted into the well. The conventional valves are frangible so that the closure may be forcibly opened by either hydraulic pressure or an impact force.

Another method is to use two flapper valves that may be independently operated. The dual flapper valves are closed and fractured independently of each other in order to accommodate gravel pack operation, a well logging operation, and a completion fluid recovery operation. The lower flapper valve is propped open by the wash pipe during a gravel pack operation and closes when the work string is removed. The lower closure plate is fractured when the well logging operation is begun, while the closure plate of the upper flapper valve is held open by a prop sleeve. After the well logging operation is complete, the prop sleeve is retracted and the upper flapper valve closes. Then the work string is removed and the completion fluid is recovered. The upper closure plate is fractured when the production operation is begun.

An illustration of a prior art implementation of this method is shown in FIGS. 1A and 1B. The upper and lower flapper valve assemblies 10A, 10B in combination define a dual flapper valve assembly, with each flapper valve being selectively closed and capable of being fractured independently of the other to accommodate separate well service operations. Each flapper valve assembly includes a valve body 66A, 66B that is mounted on a connector sub 68A, 68B, respectively. Frangible valve closure plates 70A, 70B are pivotally mounted onto the respective valve bodies for sealing engagement against an annular, elastomeric valve seat 72A, 72B, respectively. Each annular valve seat is formed of a compressible elastomeric material and is concentric with the cylindrical bore 74A, 74B of the valve body. Each closure plate has an annular, beveled surface 75A, 75B for producing close sealing.

The valve closure plate 70B is pivotally mounted onto the valve body 72B by an elastomeric hinge 76B. The valve closure plate 70A is likewise pivotally mounted onto the valve seat 72A by an elastomeric hinge 76A.

Each valve body 66A, 66B is mounted onto the connector subs by screw fasteners 78A, 78B. Each valve body is sealed against a connector sub 68A, 68B by an annular elastomeric seal 80A, 80B, respectively. The elastomeric hinges 76A, 76B are anchored onto the valve body 72A, 72B by screw fasteners 78A, 78B, respectively. Each elastomeric hinge includes a tubular metal insert 82A, 82B for receiving the threaded fasteners 78A, 78B, respectively.

The frangible closure plate 72B of the lower flapper valve 10B has an elastomeric bumper 84 which engages the wash pipe 46 and is propped open during the gravel pack operation when the wash pipe is extended through the packer. According to this arrangement, the lower flapper valve 10B is closed automatically upon withdrawal of the wash pipe 46 as shown in FIG. 1B. The closure plate 70B of the lower flapper valve 10B remains closed against the valve seat 72B while the service fluids are displaced by heavy completion fluids. Thus, after the reverse-flow circulation-out operation has been performed, and the well annulus has been filled with heavy completion fluid, the service tool and wash pipe can be withdrawn without loss of the completion fluid.

During the course of the gravel pack operation, the lower flapper valve 10B is held in open valve position by the wash pipe 46. Upon withdrawal of the wash pipe, the valve closure element 70B moves automatically to the closed and sealed position as shown in FIG. 1B, thereby containing the completion fluid and preventing its release into the formation. With the flapper valve 10B thus protecting the formation, clean-up operations, for example, cleaning up the well bore, can be carried out and the completion fluid can be recovered with the wash pipe 46 disengaged. After the completion fluid has been recovered, the work string may then be retrieved from the well and a production tubing string may be run into the well in its place. Such operations may take several days, during which time the formation is protected by closure of the lower flapper valve 10B. Upon completion of the clean-up operations and recovery of the completion fluid, a production string is inserted into the well and is sealed against the upper packer to provide for production from the formation to the surface. Before the onset of production operations, however, the lower flapper valve 10B must be fractured to open the flow passage in the screen support sub so that formation fluids can be lifted to the surface.

Each valve closure member 70A, 70B is constructed so that it can be ruptured or otherwise destroyed in response to a mechanical or hydraulic opening force. Each flapper valve closure member is preferably constructed of a frangible material such as tempered glass, for example, a borosilicate glass having strength sufficient to withstand the expected operating pressures, which will rupture under an opening force to provide a fully opened bore through the production string. The frangible valve closure member is designed to rupture in response to the build-up of hydraulic pressure or in response to a downward penetrating impact force applied by a wire line tool or a drop bar. Preferably, each flapper valve closure member is constructed of tempered glass rather than ceramic or metal, which will reliably shatter into relatively small pieces which can be removed from the tubing by reverse flow of completion fluid. Additionally, each frangible valve closure member is supported by an elastomeric hinge 76A, 76B which is severed or otherwise cleanly separated from the valve closure element to provide clear passage through the valve in response to a rupturing force imparted by hydraulic or mechanical means directed onto the frangible sealing member.

Each valve body 66A, 66B is provided with a fluid passage bore 74A, 74B, respectively, and each valve housing 88A, 88B is provided with an enlarged bore 90A, 90B which defines a valve chamber 92A, 92B, respectively, to accommodate movement of the flapper valve closure member 70A, 70B from the valve open position as shown in FIG. 1A to the valve closed position as shown in FIG. 1B. The valve closure members 70A, 70B and hinges 76A, 76B are movably coupled to the valve bodies 66A, 66B which are mounted onto the connector subs 68A, 68B, respectively.

The lower flapper valve assembly 10B is provided with a fluid passage bore 74B and a beveled counterbore that defines a valve pocket. The side wall of the bore transitions along an annular sloping face which supports the resilient, annular seal 72B, preferably constructed of an elastomeric material. The valve closure member 70B has an annular, beveled side wall 75B which is dimensioned for surface-to-surface engagement with the beveled face of the annular seal 72B. Construction of the upper flapper valve assembly 10A is substantially identical to assembly 10B.

Each elastomeric hinge 76A, 76B is joined directly to the cylindrical side wall of the glass disk in a process in which the molecular bond is produced at the interface between the elastomeric hinge and the glass during molding. Additionally, the bumper pad 84 of an elastomeric material is bonded to the underside of the glass closure disk 70B. The purpose of the bumper pad 84 is to engage and ride against the wash pipe 46.

It will be appreciated that each glass closure member 70A, 70B when impacted by a drop bar will shatter thoroughly into relatively small pieces. Additionally, a fracturing impact force will tend to cause the glass disk to cleanly separate from its elastomeric hinge. It will be observed that the elastomeric hinge, because of its construction and mounting arrangement, does not project into the fluid flow passage. Moroever, any residual fragments of the glass disk which remain joined to the elastomeric hinge will be easily broken away and will not interfere with subsequent operation of a downhole operation.

The upper and lower flapper valve assemblies 10A, 10B are joined together by a threaded union in tandem relation, thereby defining a controllable flow passage 96 which extends from the packer to the screen. In the embodiment shown in FIG. 1A, the upper and lower flapper valve assemblies 10A, 10B, the packer, cross-over tool, wash pipe 46, tail pipe 46T and screen are run in assembled, with the tail pipe 46 extending in sealed engagement against the nipple into the screen, with the lower flapper valve closure member 70B being propped open by engagement against the wash pipe 46, and the upper flapper valve closure member 70A being held open by a prop sleeve 100.

The flapper valve closure disk 70A is held in valve open position by the prop sleeve 100. The prop sleeve 100 has a thin cylindrical side wall 102 which is concentrically received within the bore of the upper flapper valve housing sub 104A. In this embodiment (FIG. 1A), the prop sleeve 100 is secured by shear pins 106 which anchor the prop sleeve 100 onto a collar ring 108 which is fitted inside the threaded box of the valve housing sub 104A. The collar ring 108 is axially confined in a pocket formed within the threaded box by the threaded pin connector 64P of screen support sub 64. According to this arrangement, the flapper valve 10A is held open by the prop sleeve 100 during the initial run-in installation and initial service operations to permit unrestricted movement of the wash pipe 46 and other downhole tools through the flow passage 96.

The valve connector sub 68A is secured by threaded connection to the barrel 88A of upper valve housing sub 104A. Likewise, the lower valve connector sub 68B is secured by threaded pin and box connection to the barrel 88B of lower valve housing sub 104B. Each valve connector sub 68A, 68B has a bore 98A, 98B, respectively, which is concentric with the flow passage 96. According to this arrangement, the upper and lower flapper valve assemblies are selectively operable to close and open the flow passage 96 between the packer 14 and the screen 56 to protect the producing formation 48 from the effects of fluid pressure within the upper well bore annulus 42 while accommodating separate well service operations.

The upper flapper valve closure plate 70A is subsequently released by applying a shearing force against the lower annular face 110 of the prop sleeve 100. In the embodiment shown in FIG. 1A, the shearing force is applied against the lower annular face 110 of the prop sleeve 100 by a shearing tool which is run into the well until it engages the lower annular face 110 of the prop sleeve 100. The force of retraction is reacted through the shear pins 106 and the collar ring 108 until the shear rating of the pins 106 is overcome. Upon retraction and clearance of the prop sleeve 100, the upper flapper valve closure plate 70A rotates into seated engagement against the valve seat 72A, thereby closing flow passage 96 and isolating the screen 56 with respect to the packer bore 30. Thus the completion fluid remaining in the upper annulus 42 is conserved and can be recovered by pumping it to the surface.

With the foregoing arrangement, only a limited amount of heavy completion fluid is permitted to escape into the formation during an intervening well service operation such as an electrical log. An electrical log can be performed after rupturing of the lower flapper valve closure plate 70B, and prior to closure of the upper flapper valve closure plate 70A. After the remaining completion fluid has been pumped to the surface, the upper closure plate 70A is fractured mechanically or hydraulically as previously discussed, thereby opening the flow passage 96 between the packer and the screen so that production operations can be initiated.

One of the problems with the prior art methods is that they do not allow an indefinite number of flapper valves to be used. Rather, the previous inventions are limited to two flapper valves. If additional operations are desired after the two flapper valves have been expended, then the completion fluid will be lost to the formation. Thus there is a need for a method and apparatus for containing the completion fluid during all operations.

Furthermore, the prior art flapper valves may only be used once and then they are trashed. A need exists for flapper valves that may be reused. The prior art requires that the valve closure be shattered and then drawn out with the completion fluid. This places additional contaminants into the completion fluid. Thus, there is a need for a flapper valve that does not shatter when it is reopened.

SUMMARY OF THE INVENTION

The present invention solves these problems in the prior art. The flapper valve assembly of the claimed invention is designed to allow as many of the valves as are necessary to be stacked on each other. When one valve is expended, another valve is stacked on top of it so that when each work/production string is removed, the completion fluid is contained above the valve to keep it from entering the formation. Thus a flapper valve is operable until the well is killed. Rather than provide a frangible flapper, the claimed invention provides for a shearable seat that slides down when a string is pressed against the closed valve, thus allowing the flapper valve to be pushed out of the path of the string. Because only pins are sheared, the flapper valves may be reused in another well by just replacing the shear pins.

BRIEF DESCRIPTION OF THE DRAWINGS

A more complete understanding of the method and apparatus of the present invention may be had by reference to the following detailed description when taken in conjunction with the accompanying drawings wherein.

DETAILED DESCRIPTION OF THE DRAWINGS

The preferred embodiment of the present invention and its advantages are best understood by referring to FIGS. 2 through 5 of the drawings, like numerals being used for like and corresponding parts of the various drawings.

Figure 1A:
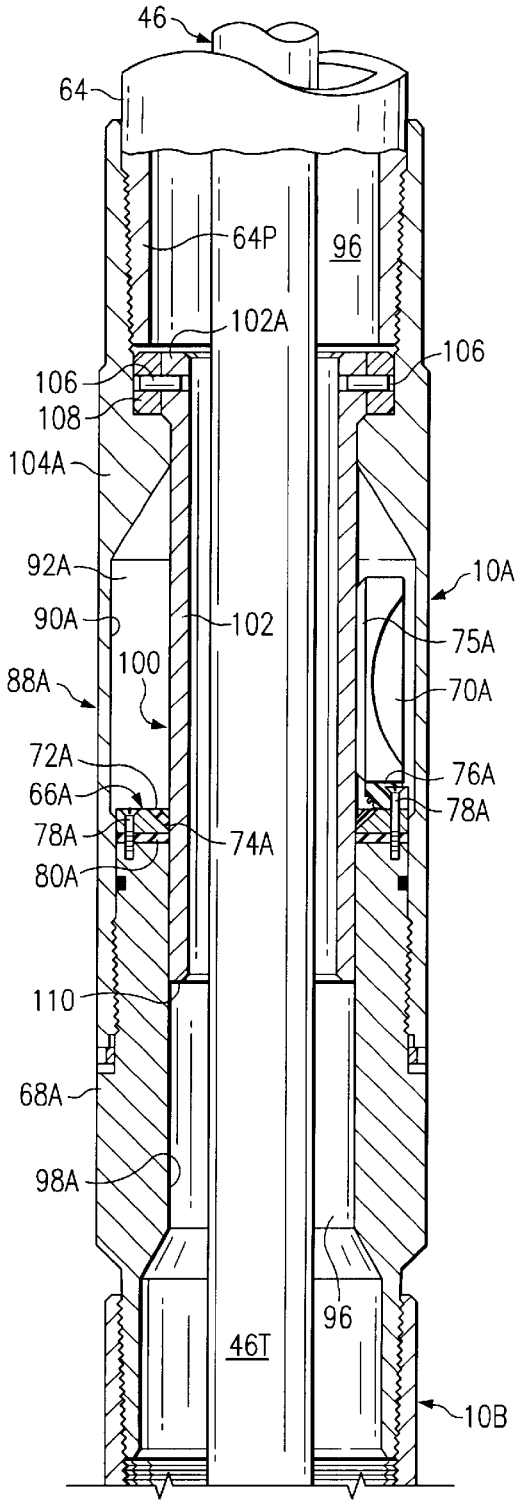
FIG. 1A (PRIOR ART)
FIGS. 1A and 1B illustrate prior art flapper valve assemblies.
Figure 1B:
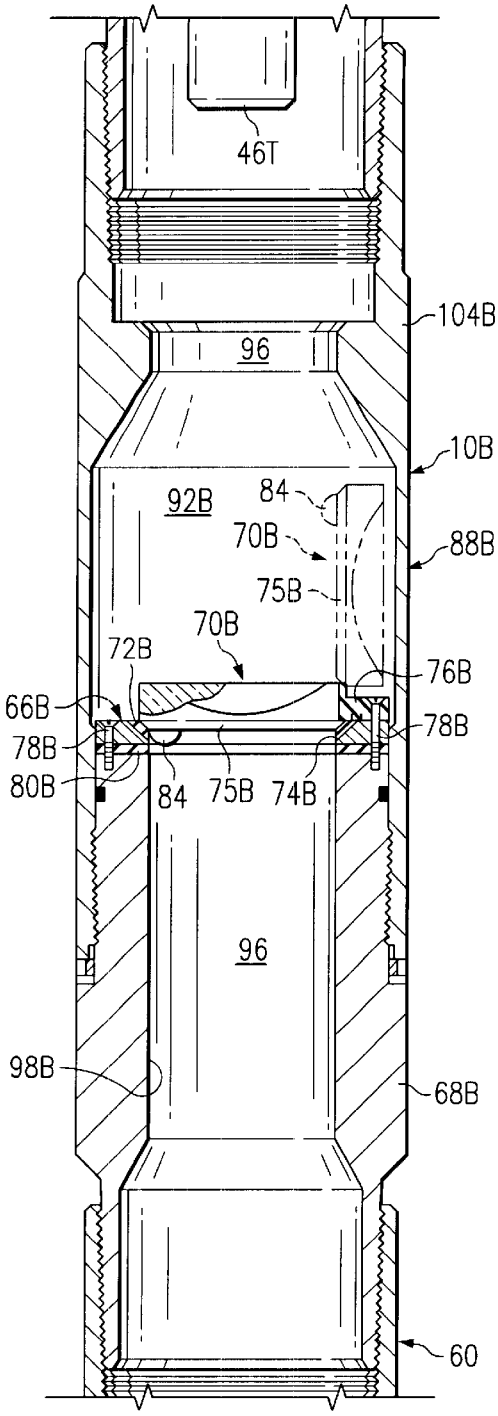
FIG. 1B (PRIOR ART)
Figure 2:
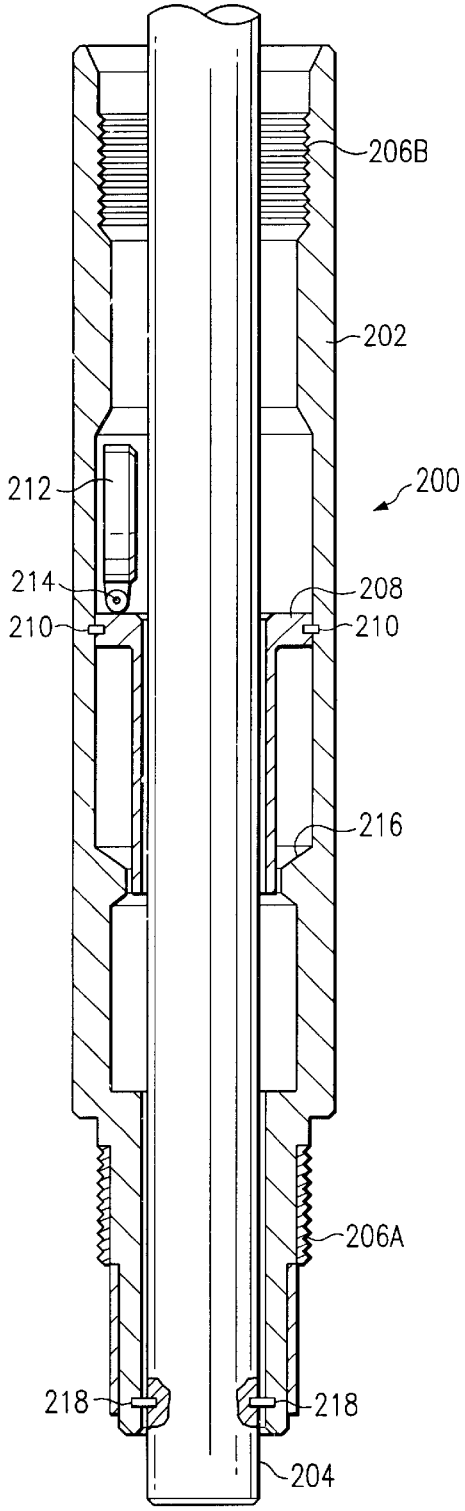
FIG. 2 is a sectional view across the present invention with a work string pinned in position through the flapper valve assembly of the present invention.

Referring now to FIG. 2, the flapper valve assembly 200 is pinned to the work string/production string 204 and run into the well. The assembly 200 comprises a housing 202 with a central passage for accepting the work string 204. The housing 202 has a connector 206*a* on a distal end that allows it to engage another element. Likewise, the housing 202 has a complimentary connector 206*b* on its proximal end. Thus, multiple assemblies 200 can be hooked in series. The connection can be any suitable connection, such as a latch. The housing and its central passage can be generally cylindrical.

The work string 204 is pinned to the housing 202 with shearable pins 218. After the assembly 200 latches to a mating downhole member, the work/production string 204 is inserted further into the well, shearing the pins 218 and freeing the work string to move freely. Thus, the flapper assembly is securely placed in position downhole. However, if the work string is withdrawn above the flapper 212, then the flapper 212 will close to the position shown in FIG. 3. The flapper has a first open position, a second closed position and a third expended position. A biasing means such as a spring is used to bias the flapper 212 from the first position to the second position. In the closed position, the flapper 212 is sized to block the central passage. The flapper is pinned to allow it to rotate approximately 180 degrees.

Figure 3:
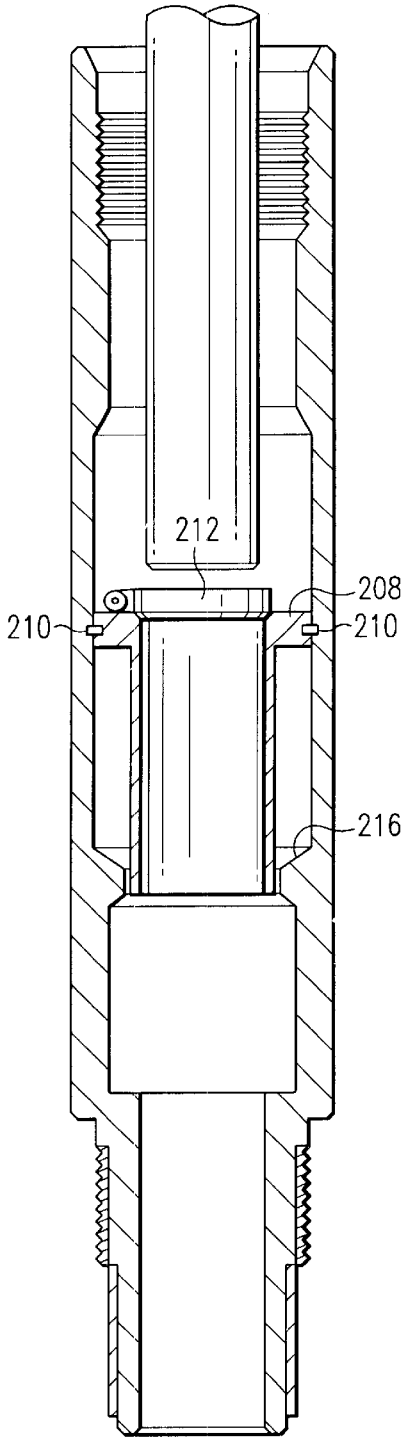
FIG. 3 shows the work string withdrawn above the flapper valve and the flapper in a closed position.
Figure 4:
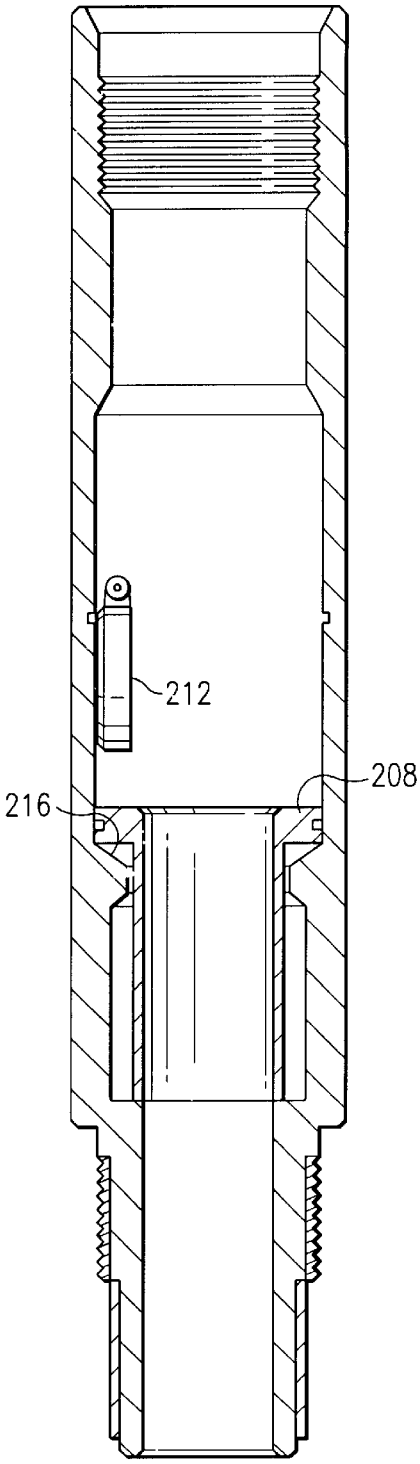
FIG. 4 shows the flapper valve in its collapsed position.

Referring to FIG. 3, the work string 204 is shown above a closed flapper 212. The flapper 212 is pinned at 214 and supported by a collar 208. The collar 208, in turn is supported by shear pins 210. When the work string is advanced toward the closed flapper 212, it will impact against an upper surface of the flapper 212. This force will shear pins 210, causing the collar 208 to descend to against shoulder 216. The shoulder 216 acts as a travel limit for the collar 208. Once descended, the flapper can rotate to a collapsed or exhausted position as shown in FIG. 4. The biasing means again biases the flapper 212 from the second position to the third position. The collar 208 also defines a central passage that the work string can continue through. The distance between pin 214 and shoulder 216 should be greater than the diameter of the flapper 212.

Once the operation for which the work string 204 was installed is accomplished then the service fluid can be pumped out using the completion fluid. Then the work string 204 is retrieved from the well.

Figure 5:
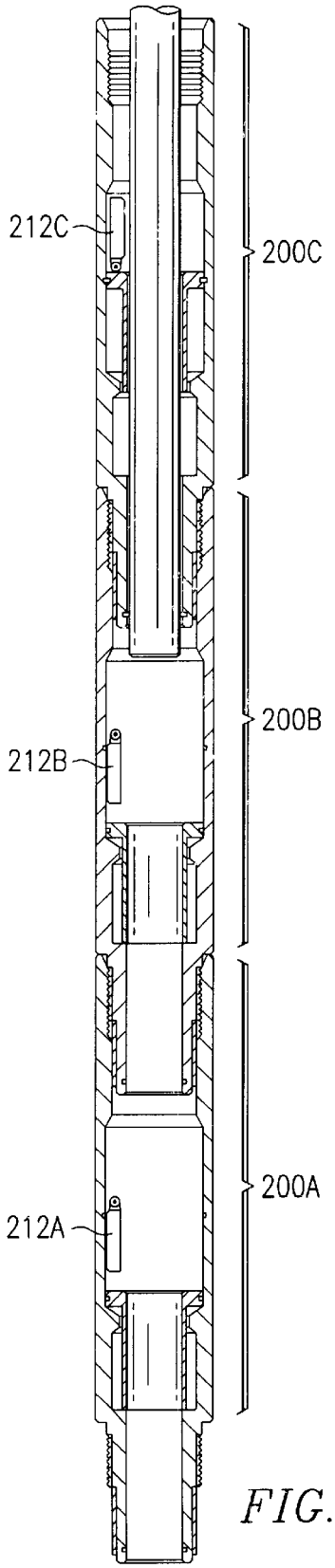
FIG. 5 shows a sequence of flapper valve assemblies in accordance with the present invention.

As shown in FIG. 5, the flapper valve assemblies 200A, 200B, and 200C can be installed in series. Thus, with each run of the work string into the well, a new flapper valve assembly may be attached. So, if the first two flapper valve assemblies 200A, 200B have been expended, a third assembly 200C can be installed. This ensures that when the work string is withdrawn, an effective flapper valve assembly will protect the formation and prevent the loss of production fluids.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A flapper valve assembly comprising:

(a) a housing defining a central passage;

(b) a reusable, non-frangible flapper pinned in said housing and having a first open position, a second closed position, and a third expended position; and (c) a collar with a central passage within said housing, coaxial with the housing central passage, wherein said collar is shearably pinned to said housing.

2. The assembly of claim 1 further comprises a shoulder within the housing that is a travel limit for the collar.

3. The assembly of claim 1 further comprises a biasing means for biasing the flapper from the first position to the second position.

4. The assembly of claim 1 further comprises at least one shear pin for coupling a work string to the valve assembly.

5. The assembly of claim 1 wherein the housing is generally cylindrical.

6. The assembly of claim 1 wherein the flapper is generally round and dimensioned to block the central passage.

7. The assembly of claim 1 wherein the flapper is pinned to allow it to rotate about the pin approximately 180 degrees.

8. The assembly of claim 1 wherein said housing has a first connector on a distal end of said assembly.

9. The assembly of claim 8 wherein said housing has a second connector on its proximal end, wherein said first and second connectors are complementary.

10. A subterranean well having a string of members suspended therein comprising:

(a) at least one flapper valve assembly having a flapper positionable within a housing between a first open position and a second closed position;

(b) a collar within said valve assembly; wherein said flapper abuts the collar when in the closed position, and wherein the collar is attached within the assembly by shearable pins.

11. The well of claim 10 wherein the assembly further comprises a shoulder within the housing.

12. The well of claim 10 wherein the assembly further comprises a biasing means for biasing the flapper from the first position to the second position against the collar.

13. The well of claim 10 wherein the assembly further comprises at least one shear pin for coupling a work string within the valve assembly.

14. The well of claim 10 wherein said assembly housing has a first connection on a distal end of said assembly.

15. The well of claim 14 wherein the assembly housing has a second connector on its proximal end, wherein said first and second connectors are complementary.

16. The well of claim 15 furl her comprises a second flapper valve assembly coupled to the first flapper valve assembly.

17. A method of expending a flapper valve assembly in a well connecting the formation to the surface, the method comprising the steps of:

(a) installing a column of pipe, said column including the flapper valve assembly;

(b) running a work string within the column and through the flapper valve assembly, wherein a flapper within the flapper valve assembly closes a central passage within the column when the work string is withdrawn above the flapper;

(c) withdrawing the work string above said flapper;

(d) impacting said closed flapper with said work string so that a collar within said assembly is sheared away within said assembly and descends allowing the flapper to rotate and the work string to pass therethrough.

18. The method of claim 17 further comprises (e) coupling a second flapper valve assembly to said first flapper valve assembly.

19. The method of claim 17 further comprises containing a fluid column above the closed flapper.

* * * * *